US007100807B2

(12) United States Patent
Louw

(10) Patent No.: US 7,100,807 B2
(45) Date of Patent: Sep. 5, 2006

(54) ELONGATED PINCH-GRIP HANGER

(75) Inventor: Henry Louw, Bergvliet (ZA)

(73) Assignee: Visconti Polyoak Ltd. (ZA)

( * ) Notice: Subject to any disclaimer, the term of this patent is extended or adjusted under 35 U.S.C. 154(b) by 220 days.

(21) Appl. No.: 10/372,509

(22) Filed: Feb. 21, 2003

(65) Prior Publication Data

US 2003/0127474 A1 Jul. 10, 2003

Related U.S. Application Data

(63) Continuation-in-part of application No. 10/118,122, filed on Apr. 4, 2002.
(60) Provisional application No. 60/281,454, filed on Apr. 4, 2001.

(51) Int. Cl.
*A41D 27/22* (2006.01)

(52) U.S. Cl. ..... 223/73; 223/85
(58) Field of Classification Search ..... 223/93, 223/96, 85
See application file for complete search history.

(56) References Cited

U.S. PATENT DOCUMENTS

| | | | |
|---|---|---|---|
| 549,145 | A | 11/1895 | Mickelson |
| 670,027 | A | 3/1901 | Malmberg |
| 1,081,058 | A | 12/1913 | Owens |
| 1,162,613 | A | 11/1915 | Kalina |
| 1,795,622 | A | 3/1931 | Taylor et al. |
| 1,893,508 | A | 1/1933 | Rosenberg |
| D146,998 | S | 6/1947 | Townsend et al. |
| 2,524,537 | A | 10/1950 | Osmonson |
| 2,573,467 | A | 10/1951 | Macaluso |
| 2,583,784 | A | 1/1952 | Maccaferri |
| 2,802,610 | A | 8/1957 | DeLier |
| 2,883,095 | A | 4/1959 | Greenbaum |
| D186,716 | S | 7/1959 | Nalle, Jr. |
| 2,939,588 | A | 6/1960 | Nalle, Jr. |
| 3,235,928 | A | 2/1966 | Clark |
| D206,207 | S | 11/1966 | Stein |
| 3,292,223 | A | 12/1966 | Esposito, Jr. |
| 3,767,092 | A | 10/1973 | Garrison et al. |
| 3,946,915 | A | 3/1976 | Crane |
| 3,950,829 | A | 4/1976 | Cohen |
| 3,973,705 | A | 8/1976 | Erthein |
| D243,138 | S | 1/1977 | Coon |
| 4,009,807 | A | 3/1977 | Coon |
| 4,023,721 | A | 5/1977 | Erthein |
| 4,123,864 | A | 11/1978 | Batts et al. |
| 4,335,838 | A | 6/1982 | Bisk et al. |
| 4,382,531 | A | 5/1983 | Bisk et al. |

(Continued)

FOREIGN PATENT DOCUMENTS

| | | |
|---|---|---|
| AU | 1525492 | 12/1992 |

OTHER PUBLICATIONS

Figs. A1 and A2—marked: B0550, Reg. Des. Patent No. [unspecified].

(Continued)

*Primary Examiner*—John J. Calvert
*Assistant Examiner*—James G Smith
(74) *Attorney, Agent, or Firm*—Ostrolenk, Faber, Gerb & Sofffen, LLP

(57) ABSTRACT

A pinch-grip hanger includes an elongated body with at least one pinch-grip positioned along the body. A pinch-grip has two opposed legs that meet at a pivot axis and the ends of the legs are movable about the pivot axis. At least one of the two opposed legs has a gripping tooth located on the lower end of the legs. A biasing force is exerted on the two opposed legs by a biasing mechanism. Pinching the upper ends of the front leg rearwardly overcomes the biasing force and separates the lower ends of the legs, thereby opening the pinch-grip.

17 Claims, 4 Drawing Sheets

U.S. PATENT DOCUMENTS

| | | | | | |
|---|---|---|---|---|---|
| 4,658,996 | A | | 4/1987 | Warmath | |
| 4,660,750 | A | | 4/1987 | Blanchard | |
| 4,706,347 | A | | 11/1987 | Lindsay | |
| D296,729 | S | | 7/1988 | Blanchard | |
| 4,759,480 | A | | 7/1988 | Duester et al. | |
| 4,763,390 | A | | 8/1988 | Rooz | |
| 4,802,265 | A | | 2/1989 | Stevenson | |
| 5,075,935 | A | | 12/1991 | Abdi | |
| 5,082,153 | A | | 1/1992 | Duester et al. | |
| 5,178,306 | A | | 1/1993 | Petrou | |
| 5,183,191 | A | | 2/1993 | Garrison et al. | |
| 5,212,854 | A | * | 5/1993 | Hollis | 24/487 |
| 5,267,678 | A | * | 12/1993 | Zuckerman | 223/96 |
| 5,297,706 | A | | 3/1994 | Blitz | |
| 5,350,092 | A | | 9/1994 | Hollis | |
| 5,361,948 | A | | 11/1994 | Batts | |
| 5,398,854 | A | | 3/1995 | Blanchard | |
| 5,400,932 | A | | 3/1995 | Hollis | |
| 5,915,605 | A | | 6/1999 | Blanchard | |
| 5,934,525 | A | | 8/1999 | Blanchard | |
| 5,992,714 | A | | 11/1999 | Morgan | |
| 6,019,261 | A | | 2/2000 | Morgan et al. | |
| 6,021,933 | A | * | 2/2000 | Zuckerman | 223/96 |
| 6,050,461 | A | | 4/2000 | Batts et al. | |
| 6,173,872 | B1 | | 1/2001 | Cohen | |
| 6,305,586 | B1 | | 10/2001 | Wong | |
| 2002/0145016 | A1 | * | 10/2002 | Louw | 223/93 |

OTHER PUBLICATIONS

Figs. B1 and B2—marked: B555, Reg. Des. Patent No. [unspecified].
Figs. D1 and D2—Manufacturer: Visconti/Sliding pinch grip.
Figs. E1–E3—Manufacturer: Visconti.
Figs. F1 and F2—Manufacturer: BATTS/Foxlock®.
Figs. G1 and G2—Manufacturer: A&E Products/Galaxy®/Secure Lock®.
Figs. H1 and H2—Marked: B556, Reg. Des. Patent No. 8821187.
Fig. I1—Manufacturer: Randy Hangers/Grip Clip®.
Figs J1 and J2—Manufacturer: Mainetti/Redwing Products.
Figs. K1 and K2—Manufacturer: The Accessory Corp.®.
Figs. L1–L5—Manufacturer: Galaxy®/A&E Products, Style #6012.
Figs. M1–M2—Manufacturer: Uniplast.
Figs. N1–N3: Manufacturer: Batts.

* cited by examiner

ELONGATED PINCH-GRIP HANGER

RELATED APPLICATIONS

This application is a continuation-in-part of U.S. patent application Ser. No. 10/118,122, filed Apr. 4, 2002 which claims priority from U.S. Provisional Patent Application No. 60/281,454, filed Apr. 4, 2001, entitled PINCH-GRIP HANGER, and the text of both U.S. patent application Ser. No. 10/118,122 and U.S. Provisional Patent Appln. No. 60/281,454, is incorporated by reference herein.

BACKGROUND OF THE INVENTION

1. Field of the Invention

The present invention relates to garment hangers and, more particularly, to garment hangers that are capable of displaying garments through the use of pinch-grips on each end of the hanger body.

2. Description of the Related Art

Various types of pinch-hangers are known. These hangers include an attachment portion for securing the hanger body to a support (typically, a hook that secures the hanger body to a rod), and pinch-grips attached to the hanger body, typically at opposite ends thereof. Each pinch-grip includes a pair of vertically-extending gripping components, a mechanism for pivotally securing the components together, and a mechanism for biasing the bottom ends of the gripping components together. Typically, each gripping component has an upper end, a lower end and a central or connecting component portion between the ends. The bottom ends are configured and dimensioned to cooperatively receive and maintain a garment therebetween under the influence of the biasing mechanism. Preferably, the securing mechanism pivotably secures one connecting component portion to another connecting component portion.

To insert or remove a garment from the hanger, the upper ends of the gripping components are pinched together. Applying a pinching force greater than the force applied by the biasing mechanism to the upper ends of a connecting pivots the connecting components at a pivot axis separating the lower ends of the connecting components. In this "open" or releasing orientation, the garment may be removed from or inserted into the pinch-grip. Finally, when the upper ends of the components are released, the biasing mechanism causes the components to pivot at the pivot axis and to return to their original orientation with the upper ends spaced apart and the lower ends biased together. In this "closed" or gripping orientation, the garment may be suspended between the component lower ends. If no article is between the lower ends, then the component lower ends may actually touch and abut, thereby forming an "abutting" orientation, or may overlap, thereby forming a "staggered" orientation.

Such pinch-hangers are frequently used at retail stores to display garments suspended from the pinch-grips, such as a pair of pants, a skirt, or the like. In the optimal retail setting, the garment hangers (and the garments thereon) are sufficiently spaced from one another along a rod so that the pinch-grip components are not likely to undergo a re-orientation relative to one another as a result of pressure exerted thereon by an adjacent hanger or the clothing thereon. However, in fact, the garment hangers (and the garments thereon) are usually tightly pressed, one against the next, so as to put on display to potential customers the maximum number of garments. In this situation, the pinch-grips may open as result of the pressure exerted thereon by an adjacent hanger or by the clothing thereon. As a result, the clothing supported by the pinch-grip will fall to the floor.

Even where the hangers (and the garments thereon) are not crowded together along a rod when being displayed, they are typically crowded together during handling.

In particular, pinch-hangers are not well suited for use in the transport (shipping) of garments suspended from or attached to the pinch-grips. During such transport, for economic reasons, typically as many hangers (and the garments thereon) as possible will be forcibly pushed together (i.e., crowded) on a rod or like support (such as the loops of a looped rope, known as "a banana rope") or in a box. Even if the close pressing together of the hangers (either on a rod or loop or in a box) is by itself insufficient to cause the opening of a pinch-grip, the added forces conveyed to the pinch-grip during transport may be sufficient to open the same.

Thus, when garments are transported by various vehicles, abrupt starts-and-stops, turning or the like may result in a pinch-grip opening and losing the garment. Clearly this is highly undesirable as the garment falling completely or partially onto a floor may become ruined or may at least require pressing before it is ready to be displayed for sale. Likewise, labor costs are incurred in picking up the fallen garments during transport and reinserting them in the pinch-grip.

Attempts to solve these problems have sometimes resulted in creation of other problems. For example, some existing pinch-hangers have "bumpers" intended to prevent the components of the pinch-grip from being accidentally pressed. Some of these do prevent the pinch-grip from opening prematurely, but in some cases, these "bumpers" have shaped in a way that prevents comfortable access of fingers to the pressing surfaces of the upper portion, in particular larger fingers, thereby preventing the pinch-grip components from being intentionally pressed into a fully open position.

Other problems also exist in conventional pinch-hangers. For example, when garments are displayed or shipped using a pinch-hanger, the pivot area of each pinch-grip on the hanger typically has projections that leave creases or indentations in the portion of the garment proximal to the pivot area. These markings are caused because the pivot area is exposed between the bottom ends of the components comprising the pinch-grip. Also, handlers of the garments, be they employees or customers, typically force the garments as far as possible into the pinch-grip before closing it, thereby compounding the creasing problem.

Moreover, known pinch-hangers are, due to their design, restricted in their ability to accommodate and secure bulky garments having an enlarged waistband area, for example pants or jeans, such as denim jeans, having a waistband with belt loops for a belt fitted thereon.

Typically the bottom ends or gripping parts have "teeth" that are able to dig into the garment because the garments can be heavy and these "teeth" are required to effectively maintain a grip. Garment waistbands may also be thin and difficult to effectively grip. Because of this, various "teeth" configurations are used, all of which leave multiple markings on the garment that are undesirable.

The configuration of these gripper teeth can also interfere with the process of loading the garment into the pinch-grip. This is most often the case when the pinch-grip receives a thick garment that touches the teeth upon entry, or when the pinch-grip is not opened fully for some reason (for example, by not applying enough pressure on the upper end of the pinch-grip to force it into a fully open position).

Further, these teeth are typically point-shaped, i.e., angled on two sides and are arranged in multiple rows which results in an unsightly pattern of marks on the garment. Moreover, it is found that pointed teeth are not always the most effective method for reliably holding a wide variety of fabrics.

In addition, conventional biasing mechanisms used to maintain the pinch-grips closed are not entirely satisfactory. One known problem is that when the hangers are exposed to extreme temperatures (for example, in a shipping container), the plastic materials typically used for the hangers can soften and bend sufficiently to reduce the amount of pressure that the "teeth" can apply to the garment. Investigation has indicated that this is due, at least in part, to the fact that, in conventional designs, the biasing forces are not effectively directed toward the area of contact between the pinch-grip and the garment.

Thus, there exists a need for further improvements in the art for a hanger which can solve the above problems, by preventing the pinch-grips from opening due to contact with other hangers during shipment or display, by permitting reliable accommodation of bulky garments having an enlarged waistband area and by preventing garments from being "pinched" or creased in the pivot area of the pinch-grip so as to reduce garment gripper markings, while also providing enough spring pressure to secure the garment within the pinch-grip.

SUMMARY OF THE INVENTION

A pinch-grip hanger includes an elongated body with at least one pinch-grip positioned along the body. A pinch-grip has two opposed legs that meet at a pivot axis and the ends of the legs are movable about the pivot axis. At least one of the two opposed legs has a gripping tooth located on the lower end of the legs. A biasing force is exerted on the two opposed legs by a biasing mechanism. Pinching the upper ends of the front leg rearwardly overcomes the biasing force and separates the lower ends of the legs, thereby opening the pinch-grip. An optional mechanism is provided for protecting the pinch-grips from accidentally opening and another optional mechanism is provided to prevent an item held by the hanger from being pinched in the area near the pivot axis.

The gripping tooth is preferably long and thin. Herein, the term long with respect to the length of the teeth means that the length $\Delta l$ is at least four times the width $\Delta w$. By thin, it is meant that the thickness $\Delta t$ of each tooth is no greater than half of the width $\Delta w$ of the tooth. A long and thin gripping tooth is capable of gripping under a waistband the extends out of a garment better than a shorter and thicker gripping tooth. The long and thin tooth may have a flat upper surface. A flat upper surface prevents the thicker waistband from slipping off of the upper surface of the gripping tooth better than a rounded upper surface.

The length of the lower end of the two opposed legs, as measured from the pivot axis to the upper surface of the nearest tooth is, preferably, at least as wide as the waistband of a garment that the pinch-grip hanger is to hold.

In a preferred embodiment, the legs include, on the opposed surfaces thereof, vertically offset wall sections which extend in back-to-front overlapping relationship inner surface of each of the pinch-grip components and are located below to the pivot area of the pinch-grip. The opposed wall sections cooperate to form a barrier that prevents the garment from being pinched within the pivot area of the pinch-grip. In addition, the upper portions of the movable legs are angled relative to the lower portions to facilitate full opening when the upper portions of the front and back legs are pressed together. The angle is such that the upper portions of the legs do not become parallel to each other until the bottom ends have been opened sufficiently to insert a garment, for example jeans. Alternatively, the upper portions of the legs become parallel when the upper portions are fully pressed together and/or the lower ends are fully opened.

In another embodiment, a gripping tooth is laterally disposed on each lower end of the pinch-grip, such that the gripping teeth are staggered, meaning that the teeth offset and overlap each other. In alternative embodiments, the stationary gripping tooth overlaps above the movable gripping tooth or the movable gripping tooth overlaps above the stationary gripping tooth. Preferably, the offset teeth are long and thin, and are laterally disposed on respective lower ends of the two components.

These aspects and advantages of the present invention, as well as others, will become apparent from the following description of the preferred embodiments which refer to the accompanying drawings.

BRIEF DESCRIPTION OF THE DRAWINGS

For the purpose of illustrating the invention, there is shown in the drawings a form which is presently preferred, it being understood, however, that the invention is not limited to the precise arrangements and instrumentalities shown.

DETAILED DESCRIPTION OF EMBODIMENTS OF THE INVENTION

Figure 1:
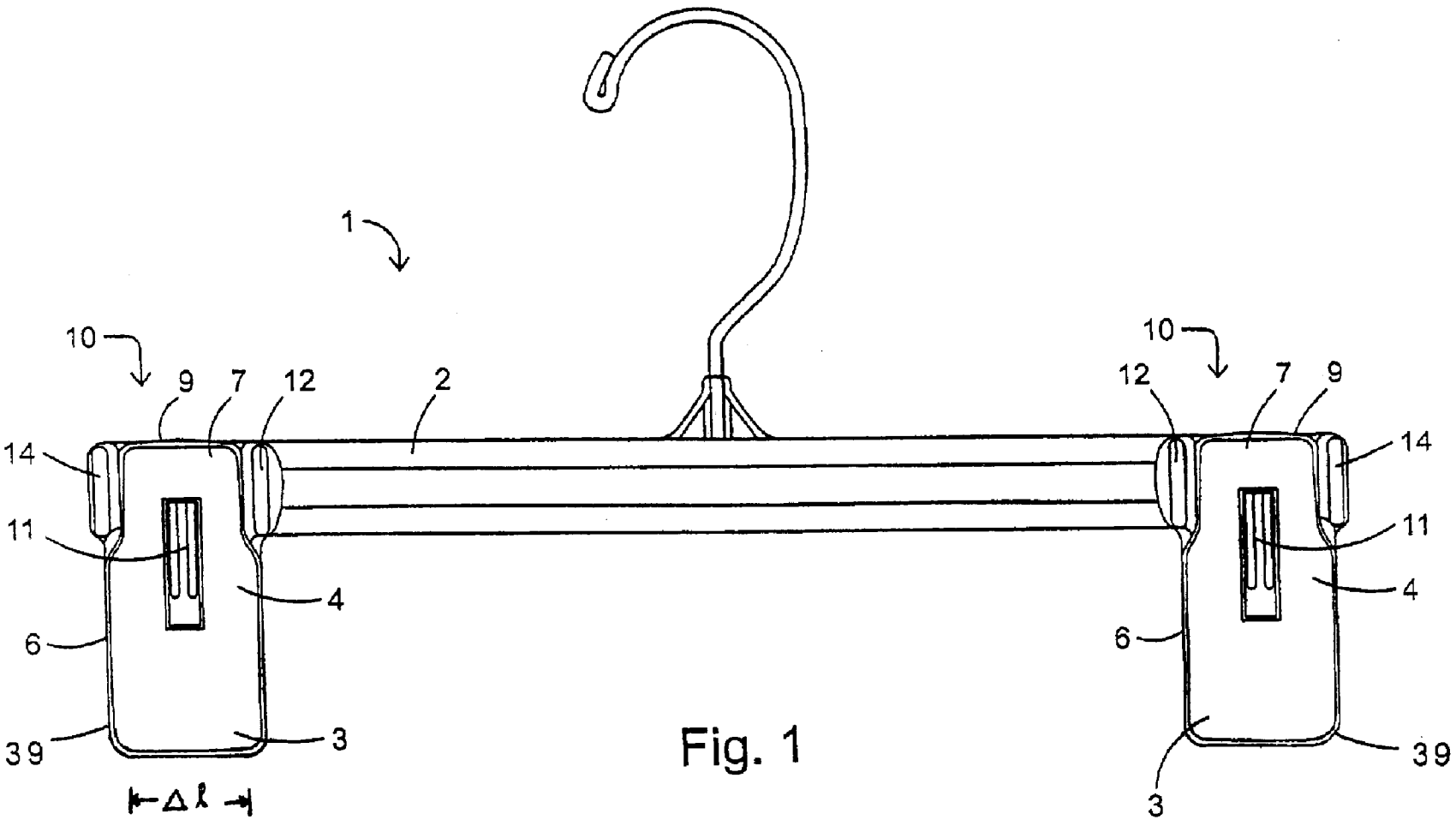
FIG. 1 is a front elevation view of a hanger in accordance with a second embodiment of the invention.

Referring to FIGS. 1–7, wherein like reference numerals indicate like elements, there is shown a pinch-grip hanger in accordance with the present invention. The pinch-grip hanger shown can be made from any suitable known material and by any suitable known method. Preferably, the garment hanger is made of injection molded plastic.

Figure 2:
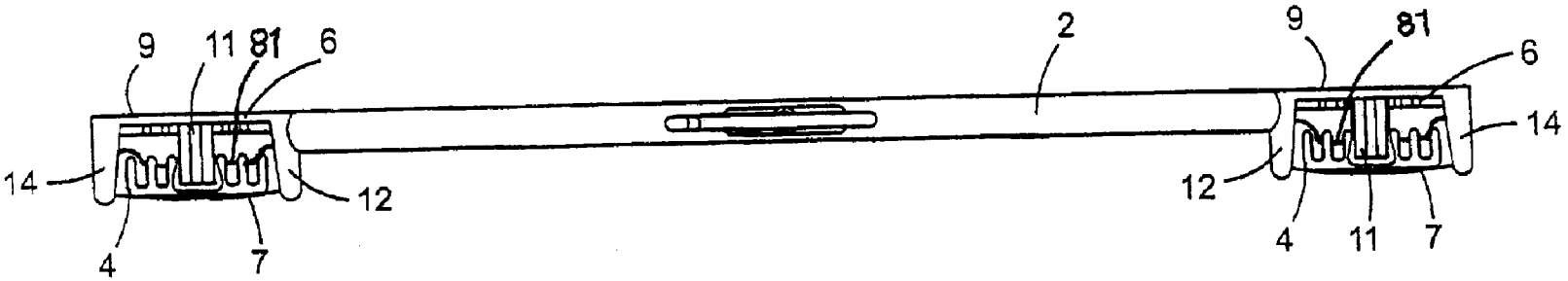
FIG. 2 is a top plan view of the hanger shown in FIG. 1.
Figure 3:
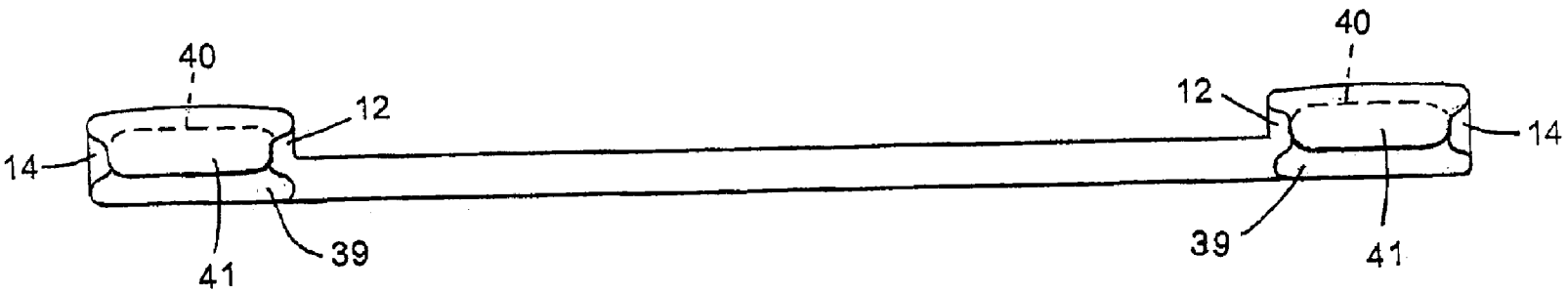
FIG. 3 is a bottom plan view of the hanger shown in FIG. 1.
Figure 6:
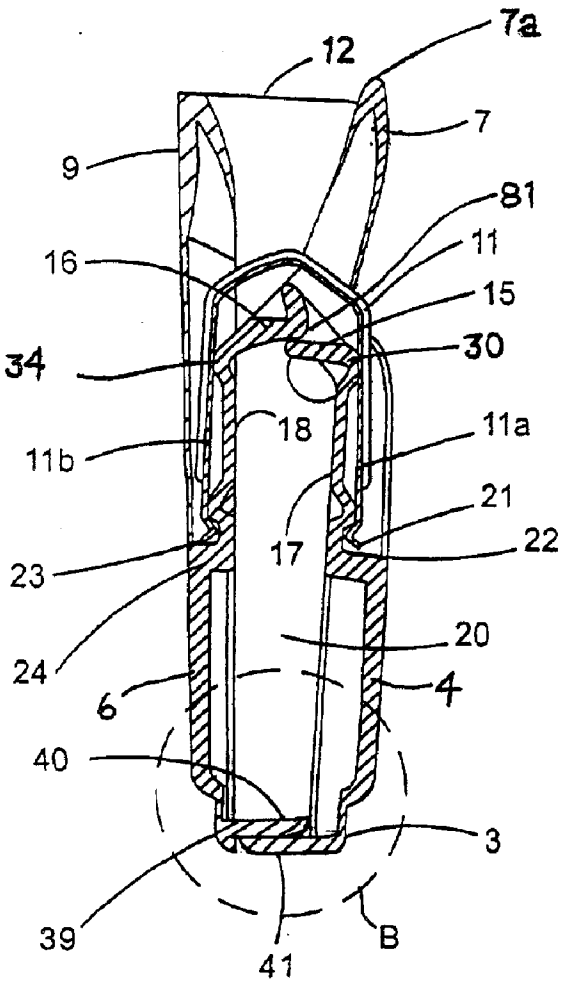
FIG. 6 is a cross sectional view of one of the pinch-grips shown in FIG. 1.

As shown in FIG. 1, the pinch-grip hanger 1 includes a pinch-grip 10 on each end of a hanger body 2. Each pinch-grip 10 includes a movable first gripping component or leg 4 and a stationary second gripping component or leg 6 secured to each other about a pivot axis 81, for example as shown in FIGS. 2 and 6. In one preferred embodiment, a U-shaped spring 11 holds the movable leg pivotably in contact with the stationary leg along the pivot axis 81 without the need of a separate pin to connect the movable and stationary legs together (similar to a common clothes pin, for example).

Each of the legs 4 and 6 includes respective lower ends 3 and 39, respectively, below the pivot axis 81 for receiving a garment therebetween and respective upper ends 7 and 9, respectively, above the pivot axis 81.

As shown in FIG. 6, the upper end 7 of the movable leg 4 is preferably angled outwardly relative to the upper end 9 of the stationary leg 6. Outward angling of the upper end 7 of movable leg 4 enables a greater separation between the lower ends of the legs by providing a greater distance through which the upper end 7 of movable legs 4 travels before contact with the upper end 9 of stationary leg 6.

The respective lower ends 3 and 39 of legs 4 and 6 preferably each includes a single gripping tooth 40 and 41 (FIGS. 3–7) with the movable gripping tooth 41 of the movable leg 4 staggered with respect to the stationary gripping tooth 40 of the stationary leg 6. Preferably, one of the respective gripping teeth is laterally disposed at the end 39 of the respective lower end of one of the movable leg 4 or the stationary leg 6.

Each of the respective gripping teeth 40, 41 is preferably thin and long. As can be seen in FIGS. 4–7, the stationary gripping tooth 40 is laterally disposed at the end of the lower end of the stationary leg 6 such that the stationary gripping tooth 40 is positioned the maximum distance from the pivot axis 81. The movable gripping tooth 41 is offset or staggered from the stationary gripping tooth 40. For example, in FIGS. 4–7, the gripping tooth is shown laterally disposed at a position on the lower end of the movable leg, a distance from the end of the lower end of the movable leg, such that when the pinch-grip is closed (no garment present), the stationary gripping tooth 40 overlaps the movable gripping tooth 41.

The respective lengths of the long, thin gripping teeth 40, 41 are such that they function to grip a garment directly below a waistband of the garment. More specifically, the length of the lower end measured from the pivot axis to the top of the movable gripping tooth, which is the maximum gripping distance, is preferably at least as wide as the waistband of the garment to be secured. In the case of a jeans hanger, this distance is preferably at least one and one-half inches (1.5 inches).

Figure 5:
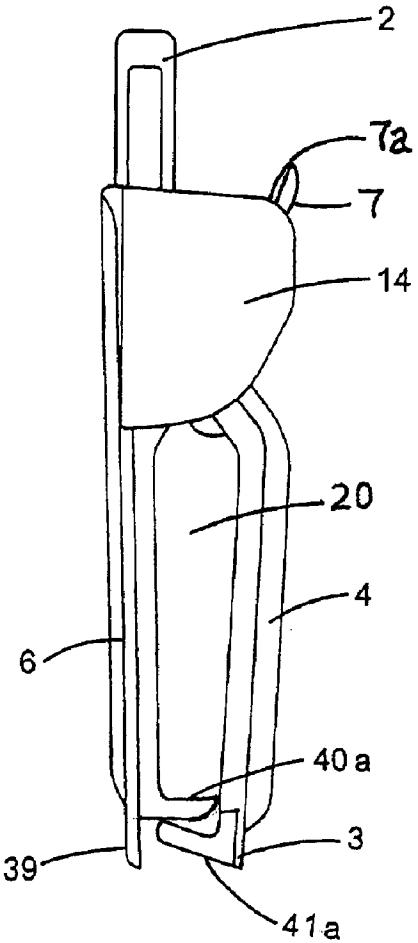
FIG. 5 is a side elevation view of another embodiment shown in the closed position.

In one preferred embodiment, the length $\Delta l$ of each of the gripping teeth 40, 41 is at least ten times the width $\Delta w$, which is at least three times the thickness $\Delta t$. The angle of the tooth with respect to the respective lower end is preferably at an angle of 90° or less. FIG. 5 shows the movable tooth 41*a* at an angle less than 90° to the surface of the lower end. The long thin aspect ratio and the angle of the respective gripping teeth 40, 41 aids in the gripping just below the waistband and prevents slipping of the garment.

Each pinch-grip 10 also includes a U-shaped spring 11 which biases the lower ends 3 and 39 of the legs 4 and 6 together and allows separation towards a fully extended open position (FIG. 4) by relative movement of the upper parts of legs 4 and 6.

To insert or remove an article, the upper ends 7 and 9 are pressed together so that the movable leg 4 pivots about the pivot axis and the lower ends 3 and 39 separate. In this "open" position (FIG. 4), the article, for example a garment, may be placed in or removed from the lower end of the pinch-grip. When the upper ends 7 and 9 of the legs are released, the U-shaped spring 11 causes the lower ends 3 and 39 of the components to return to a "closed" position, as shown in FIG. 5, for example.

A typical embodiment includes protectors or "bumpers" 12 and 14 at opposite ends thereof along hanger body 2. Bumpers 12 and 14 extend outwardly from the back leg 6 toward the movable leg 4. Bumpers 12 and 14 are designed to prevent the accidental opening of the pinch-grip 10 without preventing the intentional movement of the pinch-grip 10 into the fully extended open position of FIG. 4.

As shown in FIGS. 4–7, the inner bumper 12 may be substantially identical to the outer bumper 14. For example, when placed in a normal hanging position, each of the bumpers 12 and 14 extends outwardly to a first distance at its lower end that is less than the distance that the bumper extends at its upper end. Alternatively, the inner and outer bumpers 12, 14 may have different forms that nevertheless protect the pinch-grip 10 from accidentally opening by impact with a neighboring hanger.

Also, as illustrated in FIG. 6, when the pinch grip is closed and no garment is being held, the outermost end 7*a* of upper leg portion 7 may protrude slightly beyond the confines of the area between bumpers 12 and 14, i.e., a front-to-back distance (from the back of the hanger) slightly greater than distance that the bumper extends at its upper end. The outermost end 7*a* is at its maximum protrusion when there is no garment present and the pinch-grip 10 is closed; however, when a garment is being held, the lower portion 3 of leg 4 is opened, displacing away from the lower portion 39 of stationary leg 6 and the top 7 of movable leg 4 is displaced toward the upper portion 9 of stationary leg 6 such that the outermost end 7*a* of the upper leg portion 7 no longer protrudes beyond the front of protectors 12 and 14, and the bumpers 12 and 14 prevent contact with an adjacent hanger on a rack, keeping the garment securely by the pinch-grip 10. By protruding slightly beyond the confines of the area between the bumpers 12 and 14, the upper leg portion 7 allows more displacement of the movable leg 4 than if the outermost end 7*a* were to be limited to the extent of the bumpers, without increasing the width of the pinch-grip 10 when it is holding a garment, as would be required if the bumpers 12 and 14 were extended further.

Figure 4:
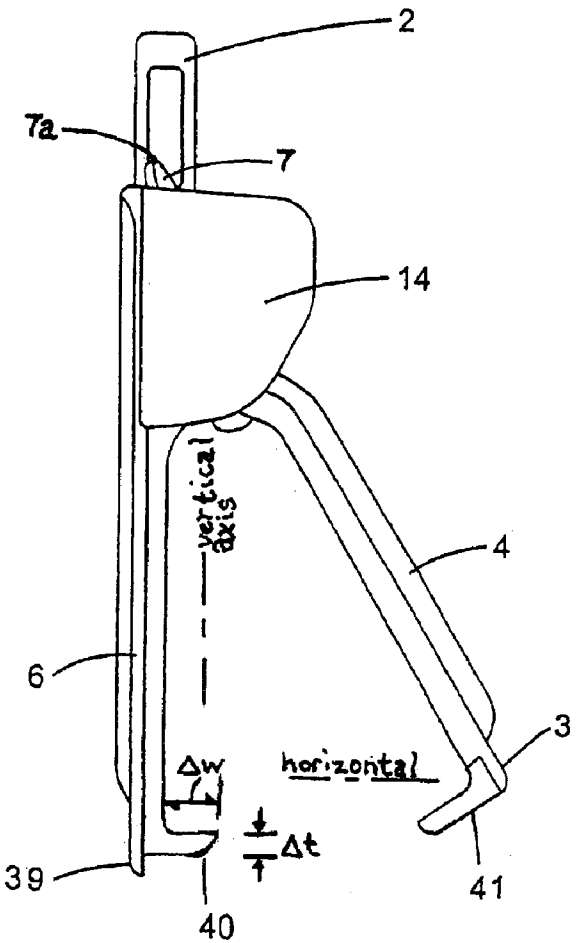
FIG. 4 is a side elevation view of one of the pinch-grips shown in FIG. 1 in the open position.

Also, the uppermost end 7*a* of upper leg portion 7 may protrude upwardly beyond the space between the bumpers 12 and 14, as shown in FIGS. 4–6. Furthermore, the spacing between the bumpers 12 and 14 may exceed the width of even a large finger and/or thumb. This design provides for easy and comfortable access of fingers to the respective upper ends 7 and 9 of legs 4 and 6 to open the pinch-grip 10. Indeed, a user can locate the upper leg portion 7 of the movable leg 4 without directly observing the pinch-grip 10.

As shown in FIG. 6, legs 4 and 6 include opposed, inwardly projecting wall sections 15 and 16 which are vertically offset and extend inwardly from the inner surfaces 17 and 18 and are located proximal to but just below the pivot axis 81 of the pinch-grip such that the garment is prevented from being pinched within the pivot axis 81 of the pinch-grip 10. These opposed inwardly projecting wall sections 15 and 16 overlap transversely in the front-to-back direction and cooperate to form a barrier within the gripping area 20 of the pinch-grip 10 that prevents the garment from being pinched by the pivot axis 81 during the opening and closing of the components. Basically, the opposed, inwardly projecting, wall sections 15 and 16 shield the garment from contact with the pivot axis 81, as the overlapping relationship illustrated in FIG. 6 is maintained regardless whether the pinch grip is open or closed.

Figure 7:
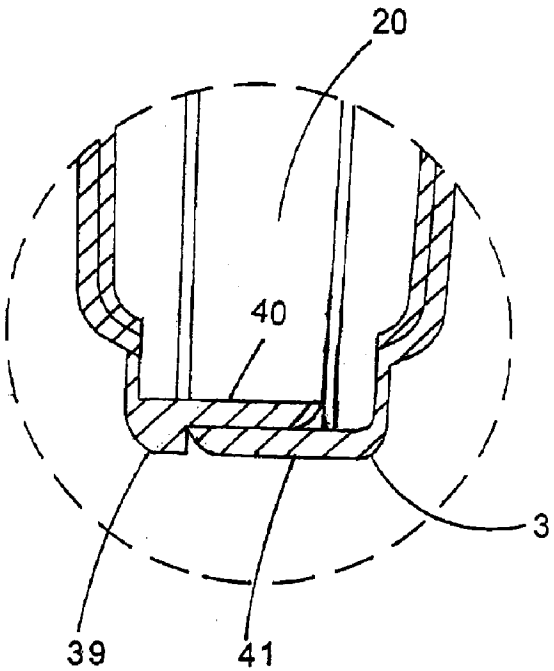
FIG. 7 is an enlarged view of section B of FIG. 6.

Also, as shown in FIG. 7, the respective lower ends 3 and 5 of legs 4 and 6 include single gripping teeth 40 and 41. These single gripping teeth 40 and 41 are thin and long, which reduces the gripping markings on the garment placed within the pinch-grip. The respective gripping teeth 40 and 41 are preferably oriented at an angle no greater than 90° to the inner surface of the lower end of the pinch grip. As shown in FIG. 7, the ends of the gripping teeth 40 and 41 may be beveled, which may improve the ability of the gripping teeth 40 and 41 to hold the garment under a projection such as the waistband of pants, requiring less bias force to be applied, for example by the U-shaped spring 11.

Reducing the bias force required for holding the garment reduces the tendency of clothes to be marked, wrinkled or marred by the gripping teeth 40 and 41. These surfaces reduce garment slip and help retain the garment in place within the pinch-grip by gripping under the garment folds or stitching lines, as opposed to typical "teeth" which have upper surfaces which are angled downwardly between 30° and 45° with respect to the surface of the leg of the pinch-grip, thereby allowing the garment to more easily "slip" from the pinch-grip.

Additionally, the upper surfaces of gripping teeth 40 and 41 preferably form a flat surface, substantially perpendicular with respect to the vertical axis of the pinch-grip, as shown in FIG. 4. By substantially perpendicular with respect to the vertical axis of the pinch-grip, it is meant that the flat surface lies at an angle in the range of about 10° above and below the horizontal while the pinch-grip is holding a typical garment. One of ordinary skill in the art will understand that the angle will vary depending on variety of factors, including the mechanism used for a pivot axis, the shape of the movable leg 4, the initial angle of the flat surface of the gripping tool 41, 41*a* and the thickness of a typical garment. For example, FIG. 4 shows that the flat surface of the gripping tooth 41 of the movable leg 4 changes its angular orientation with respect to the vertical and horizontal axis of the hanger during opening of the pinch-grip 10, as compared to the closed position shown in FIGS. 6 and 7.

As shown in FIG. 5, the gripping tooth 41*a* has an angle with respect to the surface of the movable leg 4 that is less than 90°, which ensures that the angular orientation with respect to the horizontal axis will be substantially perpendicular with the vertical axis of the pinch-grip 10 when the hanger is partially opened and is being used to hold a garment.

Moreover, the use of the single gripping teeth 40 and 41 in conjunction with the substantially flat surfaces allows for the formation of a cavity or "free space" within the gripping area 20, for example as shown in FIGS. 5–7. This "free space" allows for the accommodation of bulkier or thicker garments within the pinch-grip while also accommodating traditional sized garments, thereby providing a pinch grip having improved versatility.

For example, as shown in FIG. 6, to retain the spring 11 in place during the opening and closing of the pinch-grip 10, legs 4 and 6 are provided with respective recessed areas 22 and 24, and legs 11*a* and 11*b* of the U-shaped spring 11 are provided with complementary hook-shaped portion 21 and 23 which fit below projections 32 and 36. The hoot-shaped portions 21 and 23 of the legs 11*a* and 11*b* of the spring 11 seat within the associated recessed areas 22 and 24 and retain the spring 11 in place on the pinch-grip during the opening and closing thereof.

Additional projections 30 and 34 on the middle portions of legs 4 and 6 may be used to engage the opposed legs of spring clip 11 near the top thereof to assure proper positioning of the spring clip during operation.

In one preferred embodiment, the lower ends 3 and 5 of the pinch-grip legs 4 and 6 are extended, or elongated below the point at which the biasing force is applied by the spring 11, to allow the pinch-grips to grab difficult to hang garments with enlarged waistbands or waistbands with a belt fitted thereto. This lengthening of the gripping space 20 permits the respective gripping teeth 40 and 41 to engage the garment below the stitching line of the waistband area. With this, the respective gripping teeth 40 and 41 grab below the thicker waistband and hold the bulky garment very securely. For example, a distance of at least 1.5 inches is preferred between the pivot axis and the uppermost surface of any one of the respective gripping teeth 40 and 41, if the hanger is to hold jeans.

Longer springs (not shown) may be used to also provide pressure directly behind the respective gripping teeth. This may not be necessary or desirable, however. Gripping underneath the waistband requires less pressure than is required for gripping the waistband directly.

Although the present invention has been described in relation to particular embodiments thereof, many other variations and modifications and other uses will become apparent to those skilled in the art. It is intended, therefore, that the present invention be limited not by the specific disclosure herein, but only by the appended claims.

What is claimed is:

1. A pinch-grip hanger for a garment comprising:

an elongated body; and first and second pinch-grips positioned along the body, each of the pinch-grips including:

a first leg having an upper and a lower end;

a second leg having an upper and a lower end, the first and second legs being in opposed front-to-back relationship;

a first gripping tooth at the lower end of one of the first and second legs, wherein the gripping tooth has a length at least four times greater than the width and a width at least twice the thickness;

a biasing mechanism that applies a biasing force to the lower ends of the first and second legs such that biasing force is directed toward the area of contact between the first and second legs and the garment, when the garment is held by the hanger; and the upper ends of the legs being relatively movable toward each other about a pivot axis to separate the respective gripping teeth, and thereby to open the pinch-grip.

2. The pinch-grip hanger of claim 1, wherein the first gripping tooth is laterally disposed at the lower end of the first leg and a second gripping tooth is laterally disposed at the lower end of the second leg.

3. The pinch-grip hanger of claim 2, wherein the distance from the pivot axis to an uppermost surface of the first gripping tooth and an uppermost surface of the second gripping tooth is at least 1.5 inches.

4. The pinch-grip hanger of claim 2, wherein the first gripping tooth is perpendicular to an innermost surface of the lower end of the first leg and the second gripping tooth is offset above the first gripping tooth when the pinch-grip hanger is in the closed position.

5. The pinch-grip hanger of claim 4, wherein the biasing mechanism is a metal clip that extends along at least a portion of the lower end of each of the first and second legs.

6. The pinch-grip hanger of claim 3, wherein the first gripping tooth is laterally disposed on an inner surface of the first leg at the lower end of the first leg and an upper surface of the first gripping tooth is oriented at an angle less than 90° to the inner surface of the lower end of the first leg.

7. The pinch-grip hanger of claim 3, wherein the second gripping tooth has an upper surface and wherein the upper surface is oriented at an angle less than 90° to an inner surface of the lower end of the second leg.

8. The pinch-grip hanger of claim 1, further comprising:

two vertically offset wall sections on opposed surfaces of each of the upper end of the first leg and the upper end of the second leg, wherein the vertically offset wall sections extend in back-to-front overlapping relationship under the pivot axis, wherein the vertically offset wall sections form a barrier that prevents the garment from being pinched within the pivot axis of the pinch-grip.

9. The pinch-grip hanger of claim 8, wherein at least one of the upper end of the first leg or the upper end of the second leg is angled relative to the lower end of the first leg or the lower end of the second leg, respectively, wherein the upper end of the first leg and the upper end of the second leg become parallel after the lower end of first leg and the lower end of the second leg are open sufficiently to insert the garment.

10. The pinch-grip hanger of claim 1, further comprising:

first and second bumpers extending from opposite sides of one of the first and second legs and extending in the front-to-back direction, wherein the upper ends of the first and second legs are separated by a front-to-back distance and wherein the front-to-back distance changes depending on the thickness of the garment being held by the hanger and wherein the maximum front-to-back distance is the front-to-back distance with no garment and wherein at least one of the first and second bumpers has a maximum front-to-back dimension less than the maximum front-to-back distance of the upper ends of the legs and equal to or greater than the front-to-back distance of the upper ends of the legs, when the pinch-grip hanger is holding the garment.

11. The pinch-grip hanger of claim 10, wherein the first gripping tooth is laterally disposed at the end of the first leg, and further comprising a second gripping tooth laterally disposed at the end of the second leg such that the first gripping tooth and the second gripping tooth are staggered.

12. The pinch-grip hanger of claim 11, wherein the second gripping tooth has an upper surface oriented at an angle less than 90° to the surface of the lower end of the second leg.

13. A pinch-grip hanger for hanging an article comprising at least one pinch-grip, each of the at least one pinch-grip comprising:

a first leg having a first upper end and a first lower end;

a second leg having a second upper end and a second lower end;

the first and second legs being in opposed front-to-back relationship, forming a pivot axis between the first upper end and the first lower end;

a biasing mechanism applying a biasing force to the first lower end and the second lower end, such that the biasing force is directed toward the first lower end and the second lower end and is effective in retaining the article hanging therebetween, even when the hanger is exposed to extreme temperatures during shipping;

the first upper end and the second upper end being relatively movable toward each other about the pivot axis, wherein applying a pinching force greater than the force applied by the biasing mechanism to the first upper end and the second upper end separates the first lower end and the second lower end; and a first gripping tooth having a length, a width and a thickness, the width being at least twice the thickness, extending outward from one of the first lower end and the second lower end and having an upper surface that is flat wherein the distance from the pivot axis to the upper surface of the gripping tooth is at least 1.5 inches.

14. The pinch-grip hanger of claim 13, further comprising a second gripping tooth extending outward from the second lower end and wherein the first gripping tooth extends outward from the first lower end, and the first gripping tooth overlaps above the second gripping tooth.

15. The pinch-grip hanger of claim 13, further comprising:

a first protector; and a second protector, wherein the first protector and the second protector extend from opposite sides of the upper end of the first leg, and wherein a portion of the first protector and the second protector extends a distance equal to or greater than a front-to-back distance determined by measuring the front-to-back distance from the front of the second upper end to the back of the first upper end, when the pinch-grip is opened to an extent that the first gripping tooth no longer overlaps the second gripping tooth.

16. The pinch-grip hanger of claim 14, wherein the second lower end of the second leg has an inner surface facing the first lower end of the first leg and the second gripping tooth has an upper surface, wherein the upper surface of the second gripping tooth is oriented at an angle no greater than 90° to the inner surface of the second lower end of the second leg.

17. The pinch-grip hanger of claim 14, wherein the second gripping tooth has an upper surface, wherein the upper surface of the second gripping tooth is oriented at an angle in the range of about 10° above and below the horizontal while the pinch-grip hanger is hanging the article.

* * * * *